US005581246A

United States Patent [19]

Yarberry et al.

[11] Patent Number: 5,581,246

[45] **Date of Patent: *Dec. 3, 1996**

[54] MULTIPLE DEVICE CONTROL SYSTEM

[75] Inventors: Scott H. Yarberry, Plano; Robert E. Rector, Richardson; Larry T. Taylor, Garland; James K. Alexanderson, Carrollton; David M. Albert, Plano, all of Tex.

[73] Assignee: Gulton Industries, Inc., Plano, Tex.

[ * ] Notice: The portion of the term of this patent subsequent to Aug. 25, 2009, has been disclaimed.

[21] Appl. No.: 840,933

[22] Filed: Feb. 25, 1992

Related U.S. Application Data

[63] Continuation of Ser. No. 473,678, Feb. 1, 1990, Pat. No. 5,142,277.

[51] Int. Cl.[6] ..... H04Q 1/00

[52] U.S. Cl. ..... 340/825.57; 340/825.38; 340/870.38; 340/310.01

[58] Field of Search ..... 340/825.38, 825.06, 340/825.08, 310 A, 505, 825.57, 870.38; 370/85.2, 85.3, 85.4; 343/220

[56] References Cited

U.S. PATENT DOCUMENTS

| | | | |
|---|---|---|---|
| 2,422,519 | 6/1947 | Barker | 340/825.06 |
| 3,255,445 | 6/1966 | Randel . | |
| 3,303,470 | 2/1967 | Brixner et al. | 340/825.08 |
| 3,384,033 | 5/1968 | Ruff | 246/187 R |
| 4,022,977 | 5/1977 | Nomura | 340/825.06 |
| 4,025,736 | 5/1977 | Chlupsa | 340/825.38 |
| 4,041,470 | 8/1977 | Slane | 340/505 |
| 4,092,599 | 5/1978 | Yee et al. . | |
| 4,262,214 | 4/1981 | Patel . | |
| 4,328,482 | 5/1982 | Belcher et al. | 340/310 A |
| 4,383,257 | 5/1983 | Giallanza et al. . | |
| 4,399,440 | 8/1983 | Douglas | 340/870.38 |
| 4,535,401 | 8/1985 | Penn | 340/825.06 |
| 4,658,243 | 4/1987 | Kimura | 340/825.06 |
| 4,692,919 | 9/1987 | West, Jr. | 340/825.08 X |
| 4,754,161 | 6/1988 | Fox . | |
| 4,807,223 | 2/1989 | Wells | 370/85.2 |
| 4,812,672 | 3/1989 | Cowan et al. . | |
| 4,825,189 | 4/1989 | Honma . | |
| 4,958,122 | 9/1990 | Main . | |
| 4,967,140 | 10/1990 | Groeneveld et al. . | |

FOREIGN PATENT DOCUMENTS

| | | |
|---|---|---|
| 2302641 | 2/1976 | France . |
| 2535133 | 10/1982 | France . |
| 2521388 | 11/1976 | Germany . |
| 2558374 | 6/1977 | Germany . |
| 3329049 | 3/1984 | Germany . |

*Primary Examiner*—Donald J. Yusko
*Assistant Examiner*—Brian Zimmerman
*Attorney, Agent, or Firm*—Darby & Darby, P.C.

[57] ABSTRACT

A train communication and control system is described having the cars of the train connected by a two-wire train line running continuously from car to car. Each car has a transmitting circuit and a receiving circuit connected across the line. Any car may be selected to be a master unit. The selection of one car as a master unit disconnects the power sources of all other cars from the train line, leaving the master unit power source as the sole power source for the line. The master unit or any other car unit communicates with each other car by causing a high voltage ("mark" state or logic one) or a low voltage ("space" state or logic zero) to be on the train line. Each non-master car can receive a communication from a transmitting circuit, or can transmit to another car by applying a low impedance across the train line to change from a "mark" state to a "space" state. The power source consists of a voltage regulator with precision constant current limit. Output voltage is maintained substantially constant until a load greater than the rated current limit causes the power source to change to a substantially constant current regulator, whereby its regulated voltage falls rapidly to the "space" state voltage.

30 Claims, 7 Drawing Sheets

MULTIPLE DEVICE CONTROL SYSTEM

This is a continuation, of application Ser. No. 473,678, filed Feb. 1, 1990 now U.S. Pat. No. 5,142,277.

FIELD OF THE INVENTION

The present invention relates to systems for controlling multiple devices, such as signs for displaying messages, as for highway traffic control systems or for display of destinations in a number of subway or railway cars. It is particularly described with respect to a system for controlling and determining the display of messages on each car of a multi-car train.

BACKGROUND OF THE INVENTION

In train systems such as subways, typically up to a dozen cars may be coupled together at a terminal, the cars being selected from a large pool of available cars. In some situations, the cars may be kept joined in pairs, which are assembled into a train. (Hereinbelow "car" shall refer to either a single car or a car-pair treated as a single car.) It is desirable that a system be provided for displaying the destination (or other message) on controllable signs in each car, under control from one point of the train. For desired flexibility, that control point should be available at any car of the train.

For enhanced versatility and flexibility in display of messages, it is desirable that such signs be electronic-controlled displays, such as have been used in electronic bus destination signs, of which one form is known as the Luminator or MAX Information Display System. In such a system a library of different messages may be stored in a memory, to be selected by an operator, for display on one or more signs such as in the front, side or rear of a bus. Such a system and a memory transfer unit for it is described in U.S. Pat. No. 4,586,157 dated Apr. 29, 1986 and assigned to the assignee of the present application. The present invention provides a system useful to control a multiplicity of such displays, such as the signs on the cars of a train or the signs of a highway traffic control system or the like.

One problem associated with subway or other electric trains is that each car has its own DC power source (as from third-rail or overhead wires or other DC power supply) and has its own ground. These grounds are separated by various and usually indeterminate impedances. When interconnecting cars with a communication line, differing voltage drops between the grounds of different cars may create undesirable "ground loops".

This is avoided by the present communication system in which at any one time power and ground are applied at only one car (a "master car"), while all other cars are isolated from their normal ground and power supply but utilize the power supply and ground of the master car. Hence, there can be no potential difference between car grounds, eliminating ground loops.

SUMMARY OF THE INVENTION

According to a feature of the invention, bi-directional data communication is provided, between a "master" unit and all other ("slave") units, where any unit of the train may be made the master unit, i.e., the master unit may be located anywhere along the train and readily changed in location at any time by converting a former slave unit to a master.

According to another feature of the present invention, each car of a train system is provided with a set of message displays or signs, and each car has its own sign control unit ("SCU"). In a multi-car train, for example, an operator may make any one of the sign control units a "master" unit, for determining the operation of all of the sign control units of the other cars, which may be deemed "slave" units. Each car (whether master or slave unit) has its own data handling apparatus, including a message memory and microprocessor for supplying a selected message from the memory to the signs, to display the selected messages. Control over what is displayed and the manner of display is centralized in the master unit.

According to yet another feature of the present invention, control from the master unit to the slave units and communication in both directions between the slave units and the master unit, are provided by causing all units to be directly coupled to the same two-wire pair (called a communication line or trainline). Such a line extends along each car, from one end to the other, both ends being unterminated and open. Thus, the trainline runs in series from car to car, and the trainline in each car is automatically joined to the next car's line when cars are mechanically coupled to one another. The trainline wire pair is not closed or terminated at either end, permitting differing arrangements of individual cars to be assembled as desired while maintaining the line extending the length of the train. Circuits in each car are placed across the line, in parallel fashion. Only the master unit controls electrical data flow along the trainline, and losses and signal noise which may be caused by circulating currents or voltage loops within a car or between cars are avoided. The trainline is preferably a shielded twisted pair to reduce noise pick up and cross talk in an ordinarily high electrical/electromagnetic environment.

Communication is made in binary digital fashion, by modulating the voltage appearing on the trainline, between a high value representing one binary bit (e.g., logic "1" or a "mark") and a low voltage value representing the other binary data bit (e.g., logic "0" or a "space"). This modulating is produced at both master and slave units by providing a normal high level voltage on the trainline (from only the master unit) and shunting the trainline by a low resistance (e.g., short circuiting the trainline) at the unit transmitting data to provide a constant current, low voltage level. The succession of high and low values then represent in digital binary form the message data or control data passing between units.

The present system also provides improved circuitry permitting communication at a high baud rate (e.g., 19,200 minimum) between a large number of units, up to a designed maximum, without degrading the data signal. In contrast, prior trainline circuits have been limited typically to the neighborhood of 1,000–1,200 baud.

The present invention provides particular circuitry and procedures for a versatile and effective arrangement for controlling a multiplicity of message displays from a single point, which may be selectably located at any of the message display locations.

Further advantages and objects of the present invention will become more apparent from the following description of a preferred embodiment, taken in conjunction with the appended drawings.

DETAILED DESCRIPTION OF THE PREFERRED EMBODIMENT

The preferred embodiment of the invention is intended for use with trains, specifically electric subway-type trains, although usable in other systems for controlling multiple signs or other devices. The invention particularly provides improved communication between and control of the display sign controllers of each car of the train.

Figure 1:
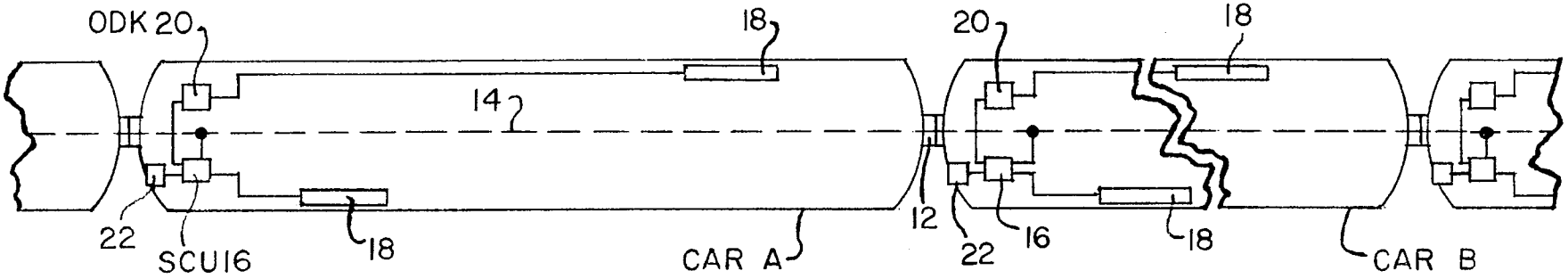
FIG. 1 is a plan conceptual view of several cars of a train showing the environment and general arrangement of the present invention.

FIG. 1 shows some of the cars of an electric subway-type train 10. Two cars are indicated as Car A and Car B. Cars A and B are connected to each other, as are the remaining cars of the train 10, through a coupling 12. The coupling 12 is a standard car-to-car coupling intended to connect two abutting cars together, both mechanically and electrically.

Figure 2:
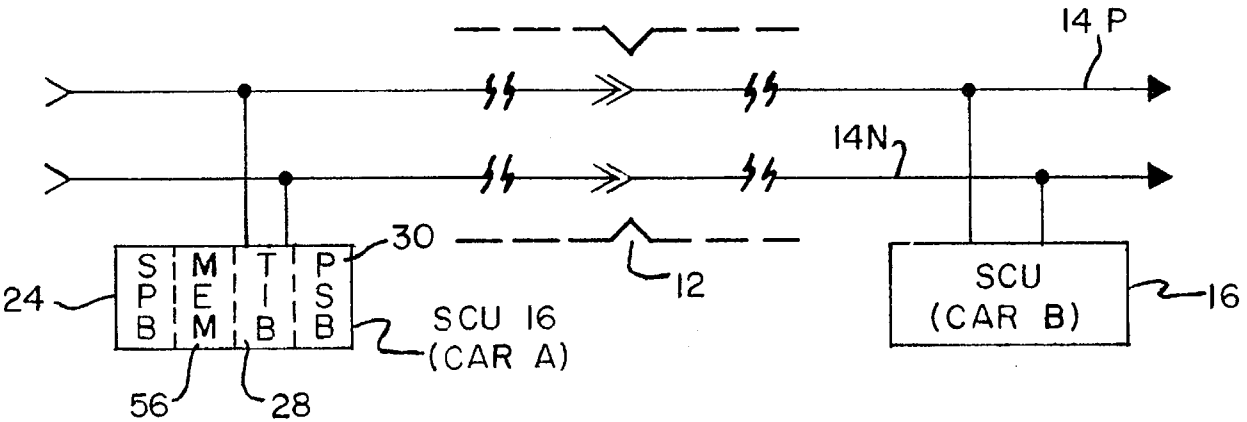
FIG. 2 is an enlarged partial view of FIG. 1 showing a coupler between the cars of the train.

In accordance with the invention, a two-wire communication line (trainline) 14 is provided along each car, to be interconnected end-to-end between all the cars of the train 10. The communication line 14 is represented in this figure as a single dashed line through the center of the cars shown in FIG. 1, but will be understood to be a shielded wire-pair, preferably twisted, to minimize noise and cross-talk pickup from other circuits which may be present in the same cable way, in the typically high electrical noise environment and strong electromagnetic fields in such cars. FIG. 2 shows an enlarged portion of the train 10 between two cars. The two wires 14P, 14N of the communication line 14 of Car A, for example, are automatically connected to the corresponding wires of the counterpart communication line 14 of Car B when Cars A and B are coupled together. All communication between the cars that relates to the control and operation of the display signs within each car in accordance with the invention is carried by the simple two-wire communication line 14.

As shown in FIG. 1, each car of the train 10 includes a sign control unit (SCU) 16, display signs 18, an operator's display keyboard (ODK) 20 and a local power source 22 such as a 5-volt DC power supply which may be part of the SCU. As indicated in FIG. 2, the SCU 16 of each car of the train 10 includes a system processing board (SPB) 24, a memory 56, a trainline interface board (TIB) 28 (which includes a microprocessor 54). Each SCU 16 also includes a power supply board (PSB) 30 (which may include source 22) for supplying the local power for the SCU for that car of the train 10.

The SPB 24 of the SCU 16 for a particular car is the display system controller of that car. The TIB 28 of each SCU 16 interconnects all of the SCUs 16 of the train 10, so that each SCU 16 can communicate with the others, along the communication line 14. As described later, any SCU 16 may be chosen to be a master SCU among all the SCUs 16 of the train for controlling the display systems of the entire train 10, by controlling the operation of all the remaining SPBs which become slave SPBs.

Two or more display signs 18 are located at appropriate positions, such as on either side of each car of the train 10, and are used to display a message, either a preselected one from the memory 56 or one inputted by an operator of the train 10 by using the ODK 20. The display signs 18 are preferably of the LCD type, such as in the Luminator MAX bus destination sign system, but any electronically controlled sign can be used with the invention, such as those using flip-dots or LEDs. The display signs 18 of each car are preferably powered directly from the PSB 30 of that car of the train 10. The control of signs 18 from SCU 16 may be accomplished in any desired manner.

An operator at any car, by use of the ODK 20 located on that car of the train 10, may communicate with the SCU 16 of that car, and thereby control the message displayed by the signs 18 of that car. In addition, by means of the TIBs 28 of all the cars connected to the communication line 14, the display signs 18 of the entire train 10 become controllable by that ODK 20. The ODK 20 includes a customary keyboard portion for command and data input and a display portion to view the inputted data and the information currently being displayed by the display signs 18. The ODK may be replaced by any source of control signals for selecting particular messages to display, such as a set of thumb wheel switches.

Figure 3:
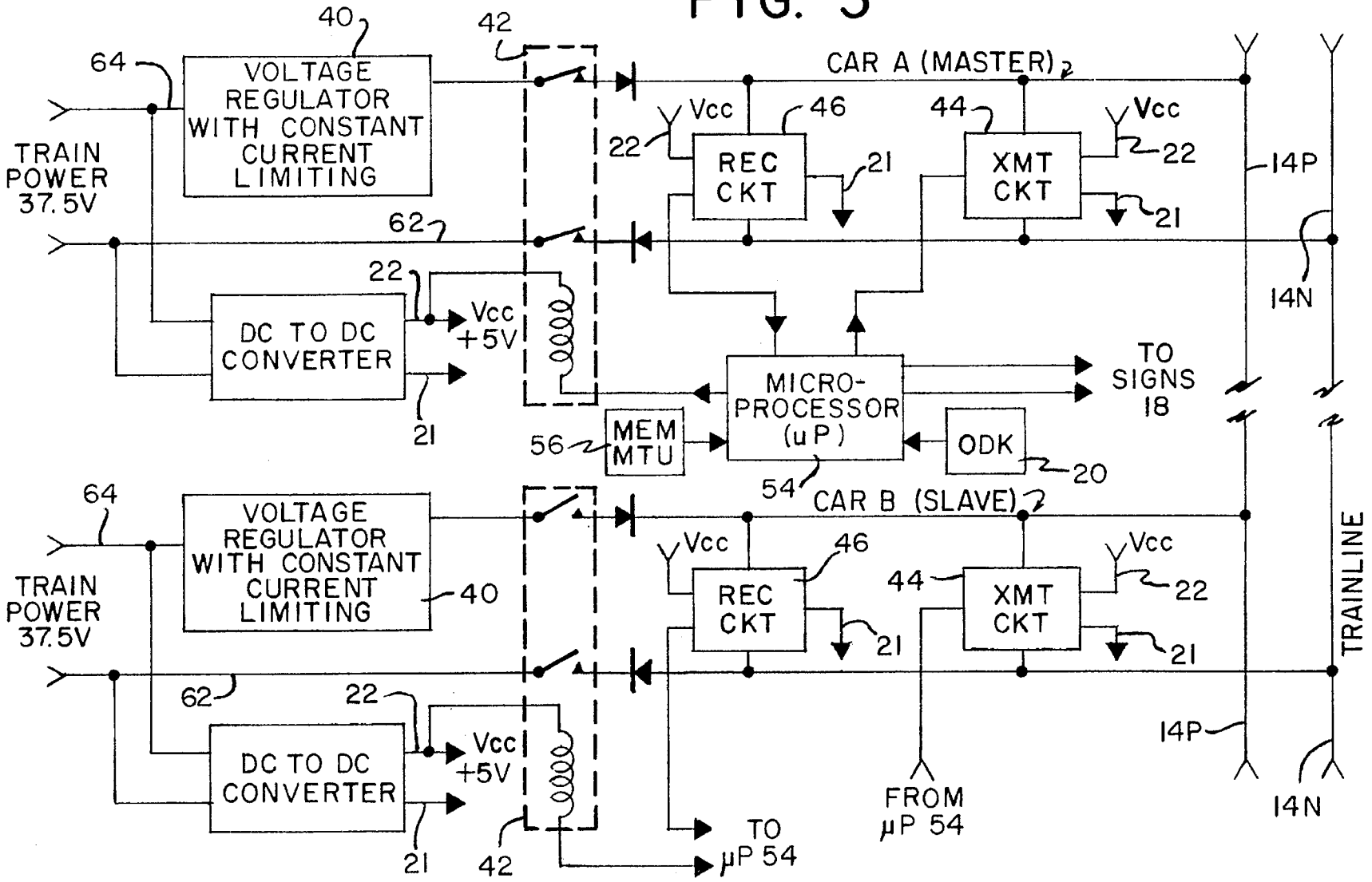
FIG. 3 is a schematic block diagram of one embodiment of the invention showing a representative circuit of both a master sign control unit and a slave sign control unit.

FIG. 3 shows a block schematic of a portion of a trainline interface board (TIB) 28 and an SPB 24 (which may be contained in microprocessor 54) of two separate SCUs 16, one SCU 16A of Car A and the other SCU 16B of Car B. It will be understood that the Car B slave unit is identical in circuit to the master unit of Car A, although only partially shown in FIG. 3. Two display signs 18 are controlled by the microprocessor 54 of each SCU 16, and an ODK 20 is an input thereto. As described below, the SCU 16 of one car may be selected by its ODK 20 to have the status of "master", while the other SCU 16 shown (and all other SCUs 16 of the train 10 not shown) are then automatically placed in a "slave" status.

Referring to FIG. 3, train power at Car A is inputted by power terminal 64 and car ground 62 to a voltage regulator and current controller 40. Details of the regulator and current controller 40 are described below; it provides a regulated output voltage which is substantially constant for current loads up to a predetermined value, and toggles abruptly to a constant regulated current with low voltage upon a very low resistance (high current) load. The output of the regulator and current controller 40 is switched in or out by a master/slave connect relay 42, which is in a closed position for the master SCU 16A and in an open position for all the slave SCUs 16, including SCU 16B, as discussed below. The master/slave connect relay 42 under the control of microprocessor 54 connects the communication line wires 14P, 14N to the regulator and current controller 40 or disconnects them from regulator 40. Whenever the master/slave connect relay 42 is closed, its SCU 16 becomes the master SCU 16 (in FIG. 3, the master SCU 16 is SCU 16A), and the output of the regulator 40 in the master Car A (in FIG. 3) is then directly connected to the communication line 14. Power from the master regulator is thereby sent to all SCUs 16B throughout the train 10, whose relays 42 are then kept open, so that no power is drawn from the individual regulator 40 of any of the slave SCUs 16B. The open relay 42 in each slave SCU 16B electrically isolates the output of the slave unit regulator 40 and the car power source 64, 62 of Car B (and all non-master other cars) from the trainline 14.

The output of the master connect relay 42 is connected, as shown, to trainline 14, one wire 14N of the trainline being a ground wire, the other 14P a positive voltage wire. The ground for all of the slave SCUs is then always the car ground 62 of only the master car, Car A in FIG. 3, thereby avoiding ground loops.

In each car, connected across the train communication line 14 and to the output terminals of the master/slave connect relay 42 is a data transmitter circuit 44 and a data receiver circuit 46. The data transmitter circuit 44 receives data from the SPB 24 (part of microprocessor 54) of the car's SCU 16A.

The data to be transmitted by the master unit is used to modulate the voltage supplied across the communication line 14 from the master regulator 40 in such a manner that allows the data to be sent along the communication line 14, with sufficient current for operation of all the slave SCUs 16. As shown below, this is done by rapidly shunting and unshunting the trainline 14 to create digital signals representative of the data to be transmitted. The transmitted modulated voltage operates the receiver components of the slave SCUs, so that they may receive such data. They also may transmit their own data to the master SCU 16A by a similar shunting operation. The operation and a preferred circuit arrangement of the transmitter circuit 44 are described in greater detail below.

The data receiver 46 of the each SCU 16 (including master SCU 16A) is also connected across the line 14, and receives its input only from line 14, independent of the local car power supply and ground. Thus, the trainline remains connected to only a single power source and ground (that of the master). The receiving circuit 46 receives any modulated signals on the communication line 14 and transmits them to microprocessor 54 which serves to control signs 18 by way of sign processing board SPB of the microprocessor.

As described above, the master SCU 16A includes both the trainline interface board (TIB) 28 and the sign processing board SPB 24. The SPB 24 controls the operation of the TIB 28 and, if it is a master SPB as in 24A, it also controls the operation of each TIB 28 and microprocessor 54 in all the other cars of the train 10.

The SPB 24 includes a microprocessor unit (MPU) 54 and a memory unit 56, each powered by the local power source 22. The microprocessor 54 of the SPB 24 of each SCU 16 of each car of the train 10 controls the related "local" functions of the particular car; for example, the microprocessor of slave Car B controls the display signs 18 located in Car B, the relay 42 of Car B and the flow of data from Car B to the master SCU (Car A, for example). The microprocessor 54 of the master SCU 16, however, controls the individual microprocessors 54 of all other cars. The master unit's microprocessor 54 only communicates serially through the trainline 14 to command the microprocessors of the slave units, but does not directly control any functions in the slave units, which is accomplished by the slave microprocessors. Communications from master to slave are initiated only by the master, and communications from slave to master (such as confirmations of commands) are as permitted by the master, in a simplex-type communication protocol, which puts data from only one unit on the line 14 at a time.

Thus, the chosen master SCU 16A powers the entire communication line 14, so that the data transmitter 44 and the data receiver 46 of each of the slave SCUs 16 operate with an isolated or floating ground, which is that (62) of the master Car A. This arrangement eliminates any problems associated with circulating currents such as might be caused by output differences in the local car power sources 64 of the different cars of the train 10. Such differences in power source can lead to static and noise generation along the communication line 14, often resulting in loss of data between SCUs 16. The load on the communications line 14 is kept small, limited to the data transmitter and data receiver circuits of the several SCUs, so that rise and fall times of the voltage are improved. Local power is supplied to other circuits of the SCUs, from their train power 64 or power source 22.

Figure 4:
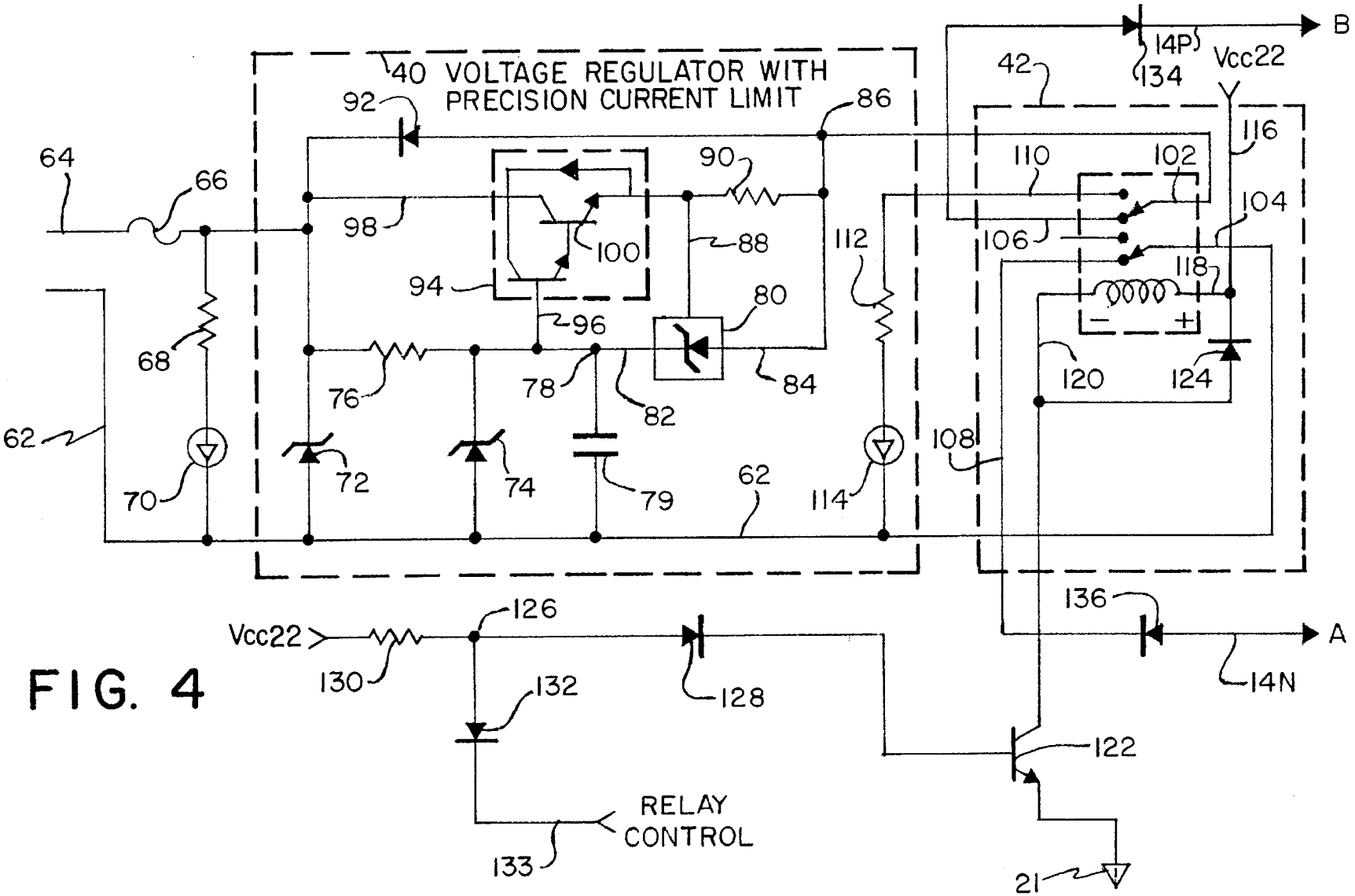
FIG. 4 is a circuit schematic of a voltage regulator and current controller and a master/slave connect relay in accordance with the invention.

Referring to FIG. 4, a preferred circuit schematic for the regulator and current limiter 40 and master/slave connect relay 42 is shown. Power is drawn from the car train power line 64. The voltage at line 64 is preferably filtered, but not necessarily regulated. The negative line 62 remains at car ground potential while the positive line 64 is at a potential which illustratively is of the order of 37 volts dc. A fuse 66 is preferably provided in line with the positive line 64 to protect the entire trainline circuit.

A light-emitting diode 70 and an appropriate series resister 68 are connected across the input leads 62 and 64 to provide a "power-on" indication for the trainline system. Zener diode 72 having a regulating voltage illustratively of the order of 40 volts is preferably connected across the power input leads 62, 64 to protect the following circuitry from any voltage transients occurring in the car power. One terminal of another zener diode 74 is connected to the positive line 64 through resister 76 defining a node 78, the other terminal of zener diode 74 being connected to the ground line 62. The zener diode 74 is used to provide a regulated voltage of a predetermined value, illustratively of the order of 15 volts dc. A capacitor 79, connected between node 78 and the ground line 62 is used to help eliminate any electrical noise within the circuit and to maintain a substantially constant voltage.

A shunt regulator 80, which may be a commercially available part (Texas Instrument's part No. TL 431, for example), includes three terminals or leads, namely, a cathode input lead 82, which connected to node 78, an output lead 84, and a reference terminal or lead 88. A resistor 90 connects the reference lead 88 of the shunt regulator to the output lead 86. A diode 92 is connected between the positive power line 64 and the output lead 86 to prevent any reverse bias voltage derived from the capacitance of the communication line 14 from injuring the circuit, as during a power failure or circuit interruption.

Element 94 represents a commercially available I.C. chip which essentially includes a standard Darlington transistor (Texas Instrument part No. TIP122). The base terminal 96 of chip 94 is connected to node 78. The collector terminal 98 is connected directly to the positive input lead 64. The emitter terminal 100 of chip 94 is connected to the output lead 86 through resister 90. The output lead 86, representing the output of the regulator and current controller 40, is connected directly to an input lead 102 of the master/slave connect relay 42. The ground lead 62 is connected directly to another input lead 104 of relay 42. Any appropriate relay may be used in the circuit of the invention; however, in this preferred embodiment, a double-pole, single-throw relay 42 is used. When the relay 42 is activated (under control of microprocessor 54), the lead 102 (positive output of the regulator 40) is switched to a positive output lead 106 (as shown in FIG. 4), and simultaneously, the negative ground line 62 is connected to a negative relay output lead 108. The positive relay output lead 106 is connected directly through an isolating diode 134 to the positive side 14P of the communication line 14. The negative relay output lead 108 is connected through an isolating diode 134 to the ground side 14N of the communication line 14. When the master/slave connect relay 42 is deactivated (or not energized), the positive lead 102 from the regulator 40 is connected to a third relay lead 110 which is connected to the ground lead 62 through a resistor 112 and a light-emitting diode (LED) 114. The resulting flow of current will light the LED 114 whenever the master/slave connect relay 42 is in its non-activated position, indicating that this SCU is in a slave configuration. The fourth relay contact is not used in this embodiment. The master/slave connect relay 42 therefore controls whether power from the regulator and current controller 40 is sent to the communication line 14, or alternatively to an indicator LED 114.

To activate the master/slave connect relay 42, a line 116 is provided from the local power source 22 to the positive terminal 118 of the coil of the relay 42. The negative terminal 120 of the coil of the relay 42 is connected to the collector terminal of a transistor 122. A diode 124 is connected between the positive and negative terminals of the coil of relay 42 for preventing any adverse effects on the operation of the relay 42 due to any reverse bias generated during deactivation of the relay coil. The emitter of the transistor 122 is connected to the return 21 for source 22. The base of the transistor 122 is connected to a node 126 through a diode 128. Node 126 is connected to local power source 22 through a resistor 130. Another diode 132 is connected between node 126 and the relay control output line 133 of microprocessor 54 of the SPB 24. An appropriate signal from the microprocessor 54 activates the transistor 122 which, in turn, controls the relay 42 by controlling the flow of current through the coil of the relay 42. Diodes 128 and 132 are used to bias the transistor so that the relay 42 can be activated precisely and quickly.

In operation of the regulator and current controller 40, the Darlington transistor 94 will provide a current flow through the resistor 90 to the output node 86. The voltage drop across the resistor 90 appears between the leads 84 and 88 of the shunt regulator 80. At a predetermined voltage drop across the resistor 90 (illustratively of the order of 2.5 volts) caused by a low resistance load on line 14, the shunt regulator 80 will become conductive between its leads 82, 84, which will change the bias on base 96 of the transistor chip 94. The resulting control by the shunt regulator 80 will then maintain a substantially fixed current output regardless of the load across the output terminals (between lead 86 and ground line 62). That current is designed to be sufficient to supply the data receiver and data transmitter circuits of the SCUs for all the cars.

The circuit is a series voltage regulator which uses a high speed constant current limiting circuit. It regulates quickly to toggle between the constant voltage mode and the constant current mode, which constitutes the transition between a mark and space for coded communication. This circuit is only used for communication. As shown below, it supplies power (e.g., of the order of one watt) to isolated sections at each data transmitter and data receiver circuit, sufficient for communication between the desired numbers of cars. Other circuitry in the system is supplied by local car power sources and power supplies.

The present invention modulates the voltage across the communication lines 14N, 14P by shunting these lines in a controlled manner dictated by the transmitter circuit 44 (described below) and corresponding to the data that is being transmitted. It is important, for high rate of data flow, that the transition between high and low voltage states (i.e., between mark and space) be rapid and certain.

Figure 5:
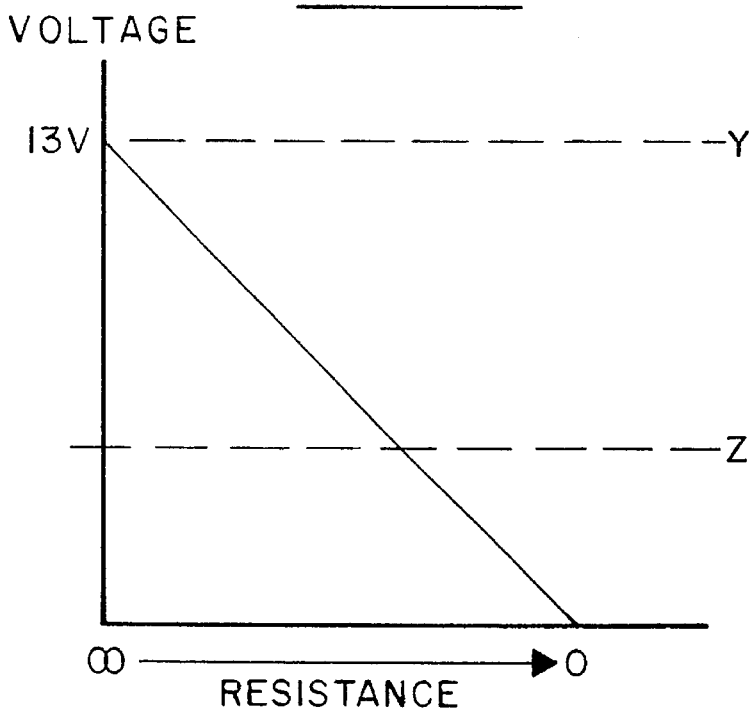
FIG. 5 PRIOR ART
FIG. 5 is a graphic representation of a typical output response of the output voltage of a prior art regulator with respect to the load across its output.

Ordinarily, the voltage across a circuit such as trainline 14 would vary with load placed on the line, as shown in FIG. 5, where the voltage varies substantially linearly with decreasing load resistance and increasing current of the load. However in the present system, slave units will be at varying distances along the train from the master unit, depending upon which unit has been caused to become the master and depending upon the location of the particular slave unit which may be in communication with the master. This provides differing resistances between the slave and the master unit, depending upon the length of line and line resistance between the then transmitting unit and the then receiving unit, each of which may be at any car of the train.

Thus, if the trainline 14 were switched between an open circuit voltage and even a full short-circuit at a slave unit to provide binary-coded information to a master unit, (or vice versa) in a conventional power supply the voltage at the receiving unit would vary from full voltage at open circuit at the transmitting unit to some different value on short circuit at the transmitting unit, depending on which unit is transmitting and its distance from the receiving unit. This produces an indeterminate voltage low at the receiving unit, which may adversely affect reliability of communication.

Figure 6:
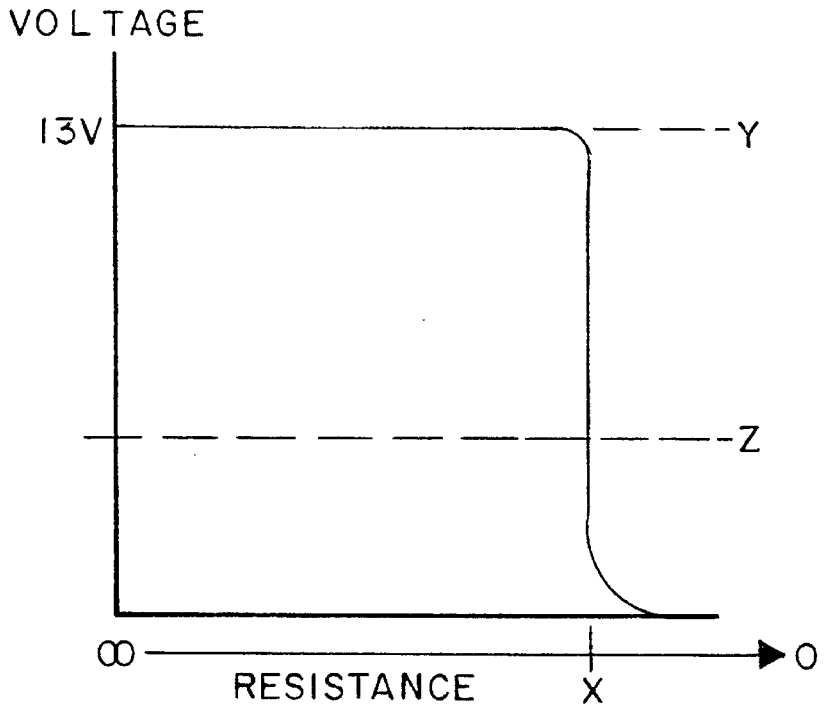
FIG. 6 is a graphic representation of the output response of the voltage of a regulator in accordance with the invention, with respect to the load across the output.

To avoid these effects and to assure that both the voltage high and the voltage low are definitive, the present invention provides an output voltage from voltage regulator 40 with a characteristic such as shown in FIG. 6, which maintains a substantially uniform (or only slightly declining) voltage output for increasing loads (and current) up to a predesigned value, at which the circuit converts to a regulated current circuit, maintaining substantially constant current (as at X, FIG. 6). The result is an abrupt voltage drop. Therefore, as the communication line 14 is shunted by a slave unit anywhere along the line, the maximum line resistance is designed to have a value less than that represented at point X of FIG. 6 so that the voltage on the trainline, previously maintained at the upper level Y, will drop sharply upon shunting of the line to a voltage well below the level Z indicative of the desired voltage "low" representing a space or logic 0. This characteristic is provided by the circuitry described above with respect to the voltage regulator 40 of FIG. 4. In this way, the two voltage states ("high" or "low") representing the logic "0" or logic "1" binary data bits are more precisely determined and data is transmitted and received with greater reliability. The result is data being transmitted from a master SCU to the slave SCUs or conversely, in the form of a clean binary data signal.

Figure 7:
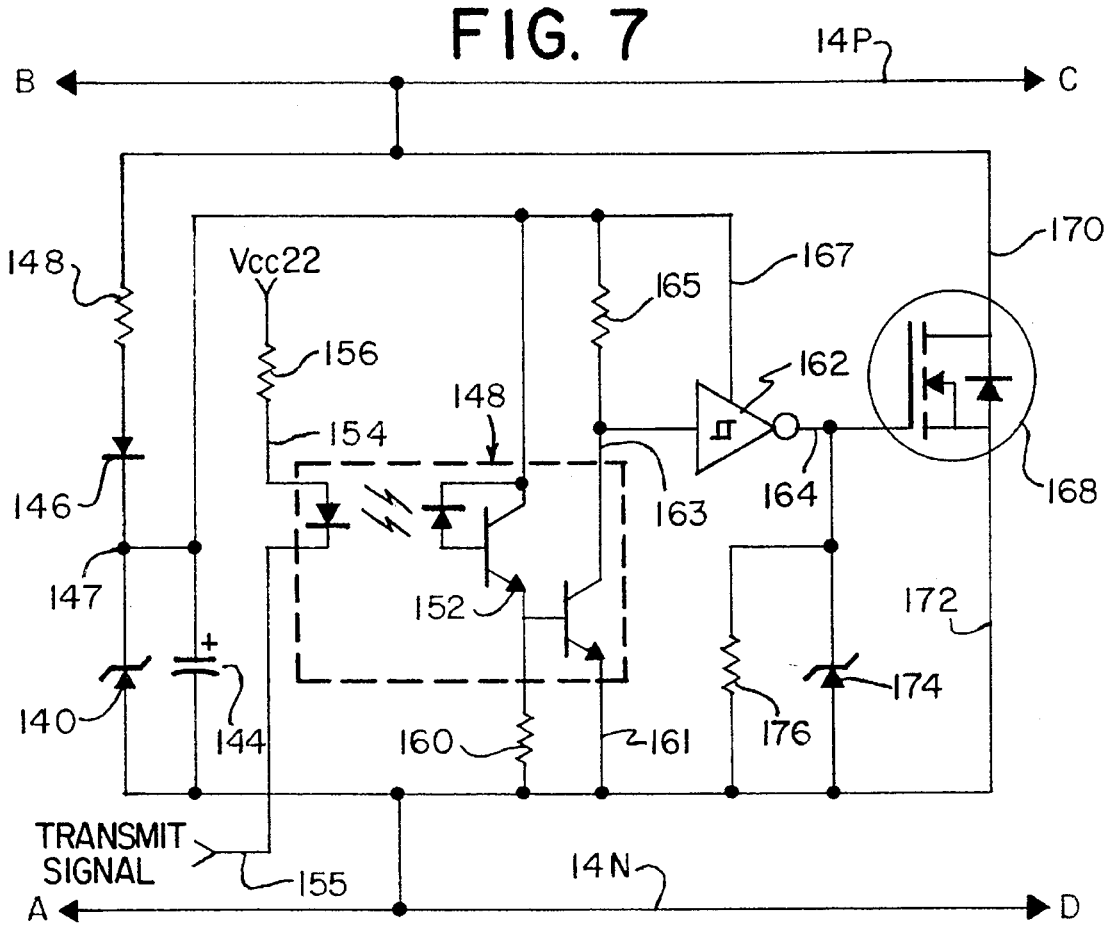
FIG. 7 is a circuit schematic of a data transmitter in accordance with the invention.

Referring to FIG. 7, a preferred circuit schematic of the transmitter 44 is shown. As indicated above, the transmitter circuit 44 is connected across the communication line wires 14N and 14P. A zener diode 140 is connected between the negative communication line 14N and a node 147. A noise-reducing capacitor 144 is connected between the negative communication line 14N and node 147. A diode 146 and a resistor 148 are connected in series between node 147 and the positive communication line 14P. The communication line 14 therefore passes current through resistor 148 and diode 146 to charge up capacitor 144 until it attains the regulating voltage (zener voltage) of zener diode 140, illustratively of the order of 13 volts. An isolating coupler 48 (preferably an opto-coupler 48 with a Darlington transistor I.C. 152, such as Texas Instruments part No. 6N139) is supplied with power from local source 22 through resistor 156 to an input portion of the coupler 48 by line 154 and is connected to the microprocessor 54 by line 155. Data from the microprocessor 54 will control the flow of current along line 154 and thereby control the input to coupler 48. The chip 152 is powered by the voltage at node 147.

The coupler 48 forwards the data signal to a conventional schmitt triggering circuit 162 illustratively in the form of an I.C. chip such as Texas Instrument part No. CD40106B. The output of the triggering circuit 162 is connected to a node 164 which is connected to the gate 166 of a power mosfet 168. The drain 170 of the mosfet 168 is connected directly to the positive communication line 14P. The source 172 of the mosfet 168 is connected directly to the negative communication line 14P. A zener diode 174 and a parallel resistor 176 are connected between the negative communication wire 14N and node 164. It is appreciated by those skilled in the art that the schmitt triggering circuit 162, the resistor 176 and the zener diode 174 are used to provide a more effective pulse wave shape with sharp rise and fall, and hence improved switching characteristics and operating performance for the mosfet 168.

In operation of the transmitting circuit 44 and coupler 48, an output voltage signal modulated by binary data representing information to be sent over the communication line 14 is produced by the transmitter circuit 44 in response to a pulsed signal sent by the microprocessor 54 over lead 155. This modulating signal is coupled through and amplified by the coupler 48 and trigger 162, to operate the mosfet 168. The mosfet 168 will become conductive between its leads 170, 172 in response to and corresponding with the pulse modulating signal and will therefore modulate the voltage across the communication lines 14N and 14P by repetitively shunting the positive communication line 14 nearly to ground, which drops the previous high line voltage to a low value during one of the binary bits of the modulating signal.

Thus, according to the present invention, communication along the trainline 14 is accomplished by transmitting data from master unit to slave unit (or from slave unit to master unit) by controlling the voltage on the trainline, by switching the line voltage from a high value to a low value, each value corresponding to a logic "0" or logic "1" bit of a binary data signal. This switching is accomplished at either the master or any slave by applying a substantially zero or low resistance load across the trainline 14 by power mosfet 168.

The voltage supplied to the communication line 14 from the master unit is used by the slave SCUs 16 to provide power for the portion of their transmitter circuits 44 coupled to communication line 14, those portions being isolated from the remainder of the SCU by the opto-couplers 148. Capacitor 144, diodes 140, 146 and resistor 148 of a slave unit serve to extract power from the voltage on line 14 so that the slave transmitter circuit 44 can return data to the master SCU merely by shunting line 14, without drawing power from its own regulator 40 (which is then cut off). While the line voltage is "high", capacitor 144 is charged through resistor 148 and diode 146 until the voltage rating of zener diode 140 is reached. When the line voltage is "low", because some unit is transmitting data, the diode 146 prevents discharge of capacitor 144, which substantially retains its voltage to supply necessary voltage for chip 152 and schmitt trigger 162. Any loss of charge is replenished when the voltage of line 14 goes "high" again, which is its rest condition as well as the condition for one of the logic bits. Therefore, the data communication circuits of the slave SCUs 16 of the train 10 are effectively powered by a single regulated voltage supply, that of the chosen master SCU 16.

In response to data or commands from the master unit, as controlled by its microprocessor, one or more slave units addressed by the master unit may respond by the transmit signal placed on its line 155, to produce binary-coded shunting of the line 14 by the slave unit's mosfet 168. The master microprocessor determines which slave unit transmits and when, by controlling the slave microprocessors so that the master and slave units do not transmit simultaneously.

Figure 8:
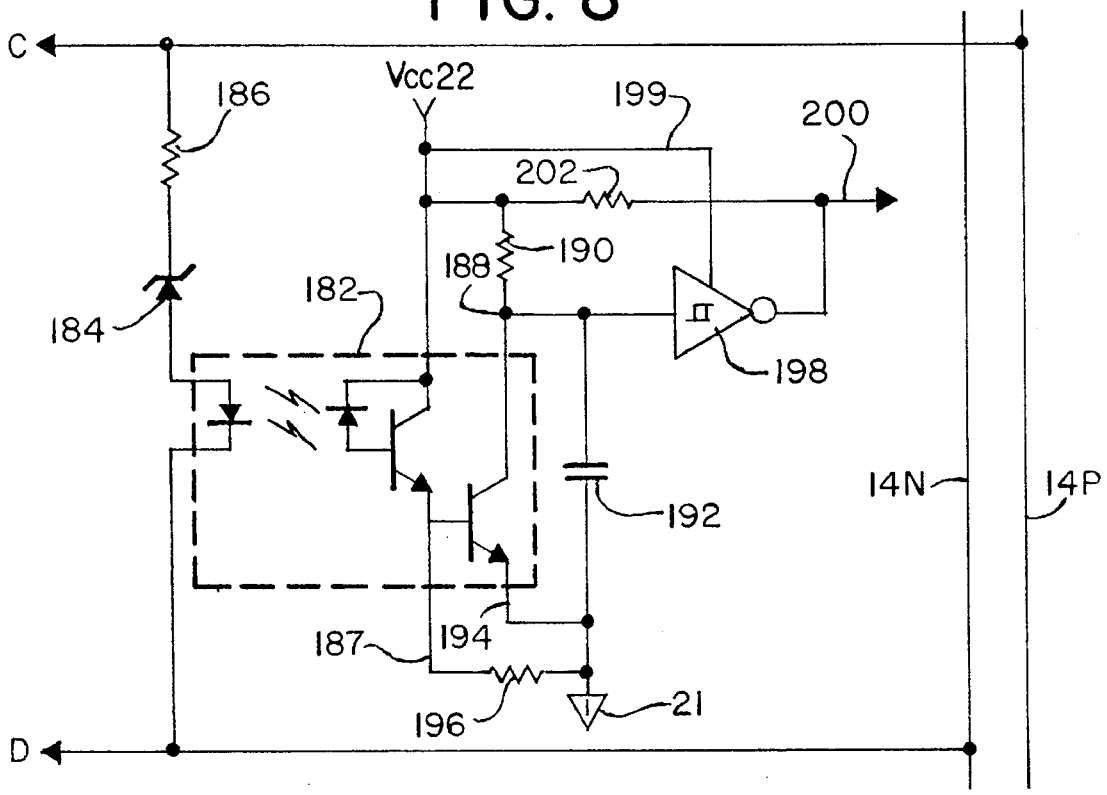
FIG. 8 is a circuit schematic of a data receiver in accordance with the invention.

All the data receiver circuits 46 of the various SCU's 16 in the system are identical and each is connected across the communication lines 14P, 14N. A preferred receiver circuit is shown schematically in FIG. 8. The switched-voltage data signal on wires 14P, 14N is supplied to an isolating coupler (e.g., an opto-coupler) 182 through resistor 186 and zener diode 184. The coupler 182 is also preferably in the form of an I.C. chip and may be the same type of I.C. chip as used in the transmitter circuit described above. The portion of the coupler 182 not connected to wires 14N, 14P is powered from the local car power source 22. An output lead 188 of the coupler 182 is connected to the power supply 22 through a resistor 190. A capacitor 192 is connected between the output lead 188 of the coupler 182 and the ground return 21 of the power source 22. A lead 194 of the coupler 182 is also connected to the ground 21. A resistor 196 is connected between terminal 187 of the coupler 182 and the ground 21. The coupler output is supplied to a schmitt triggering circuit 198 similar to the one used in the transmitter circuit described above, which is connected between the output lead 188 of the coupler 182 and a receiver circuit output terminal 200. A pull up resistor 202 is connected between the circuit output terminal 200 and the power source 22, which also energizes circuit 198 by lead 199. The output terminal 200 of the receiver circuit is then connected to the microprocessor 54, which determines the use to which the received data is to be put (e.g., to acknowledge receipt of signals transmitted from the master unit, or to supply message data to the signs 18).

As is apparent to those skilled in the art, the schmitt triggering circuit 198, the capacitor 192 and the resistor 196 are used to filter and square-off the output data pulses. Also, the zener diode 184 and resistor 186 create a threshold voltage, several volts above zero, below which the receiver will register a logic "0". The regulating voltage of the zener 184 is selected to be just greater than the voltage created at its receiver by the maximum volt drop which may be experienced along the trainline (for example, if the master is at one end of the train and a slave transmitter is at the other end of the train seeking to communicate with the receiving circuit at the master's location). Thus, so long as the trainline voltage is high (for "mark") current will flow through zener 184 into the coupler 182 input. When the trainline voltage at a receiver drops below its zener regulating voltage due to shunting at any car, the zener 184 becomes non-conductive, cutting off input to the opto-coupler, designating a "space", regardless of the differing trainline resistances to the various cars. The circuit thus defines the values of low and high voltage states so that current will flow through the coupler 182 only when the voltage detected along the communication line 14 exceeds a predetermined value as dictated by the value of the zener diode 184. Representatively, this may be about 6 volts.

The operation of the system is determined by the microprocessor 54 of the controlling (master) SCU 16 which controls the operation of all the slave SCUs 16 by controlling the microprocessor 54 in each slave SCU 16. The master microprocessor 54 uses the communication line 14 to send data to and receive data from any or all the slave SCUs, by following a specified software protocol as outlined in the charts of FIGS. 9 and 10, described below.

Figure 10:
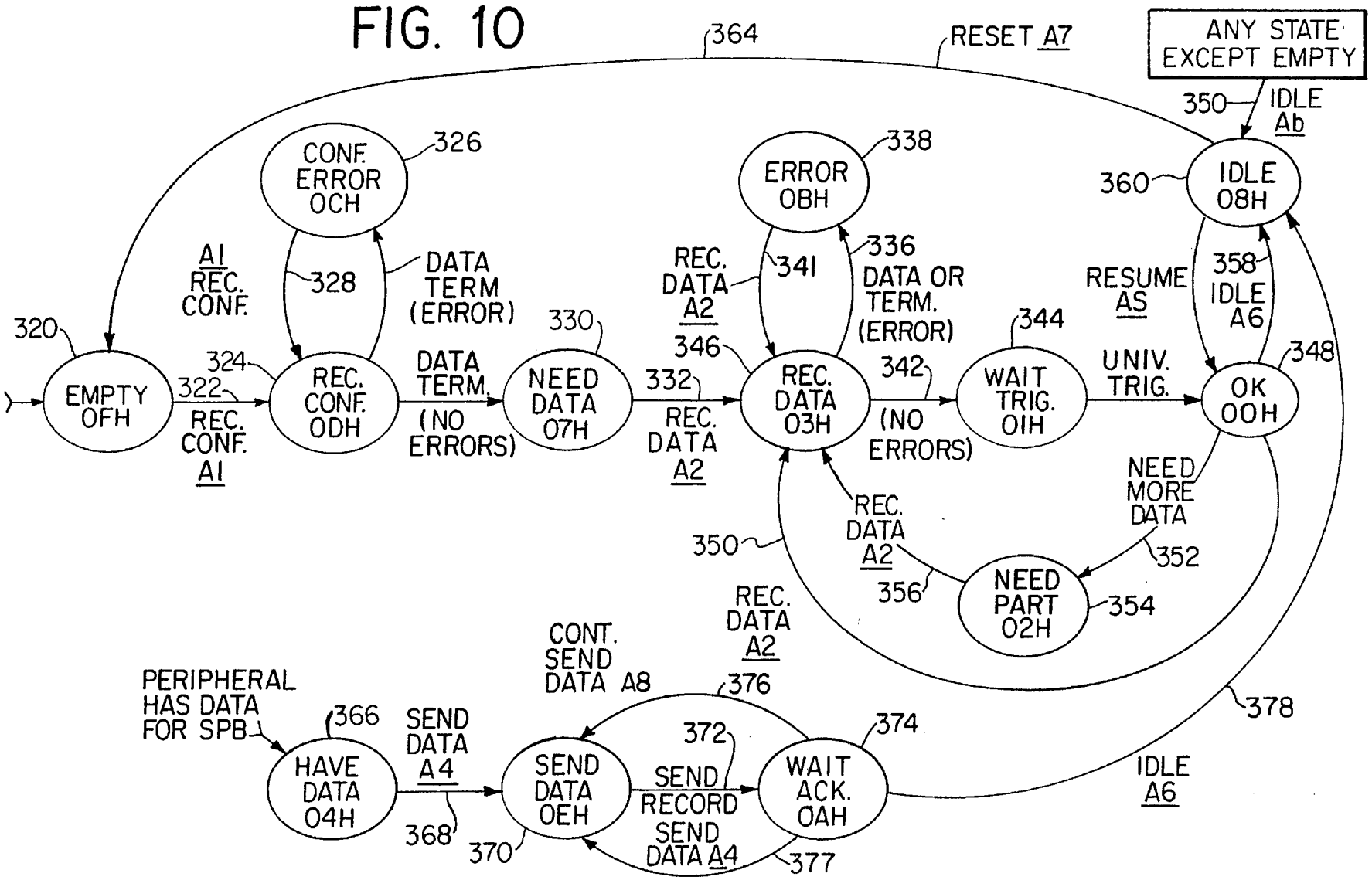
FIG. 10 is a status diagram showing the operation procedure for the master microprocessor, for several purposes.

Furthermore, the SCU 16 within each car controls each of its own peripheral devices, such as the signs 18 and the ODK 20 within the particular car. Through the use of the SPB portion of the SCU 16 of each car, data flow is controlled between the SCU of the car and the car's peripherals. The TIB portion of each SCU 16 allows the master SCU 16 of the train 10 to interface with and determine the action of all SCUs 16 together, as described above. FIG. 10 may be taken as showing also the flow of data between the SCU 16 in each car and that car's peripherals.

Customarily, each car for a train has a master switch (i.e., key-switch or forward/reverse switch) which first energizes the car such as to turn on the headlights of the car when it is a lead car. When, for example, ten train cars are connected to form a train 10, the key switch which is first activated creates a voltage which is detected by and informs the microprocessor 54 of the SCU 16 in that car to activate its master/slave connect relay 42, thereby connecting its power lines 62, 64 through its regulator 40 to the communication line 14 common to it and the other nine cars of the train 10. The connect relay 42 of all other (slave) cars is kept de-energized (by command from the master CPU 54 to all slave CPUs 54), so that no slave unit power supply 40 is connected to the communication line 14.

As a preliminary operation, the system first identifies which cars are in the train. While all cars have the same sign control equipment, each SCU (and thus each car) is assigned its own permanent pre-programmed address which is unique, so that no two cars have the same address. In the present arrangement, up to 2000 separate addresses may illustratively be used for up to 2000 cars, without duplicating addresses. Of course, the number of possible addresses may be increased, as desired, by appropriate choice of the microprocessor used and its memory capacity. Each CPU 54 thus will accept and respond only to messages or commands identified by its own specific address.

Figure 9:
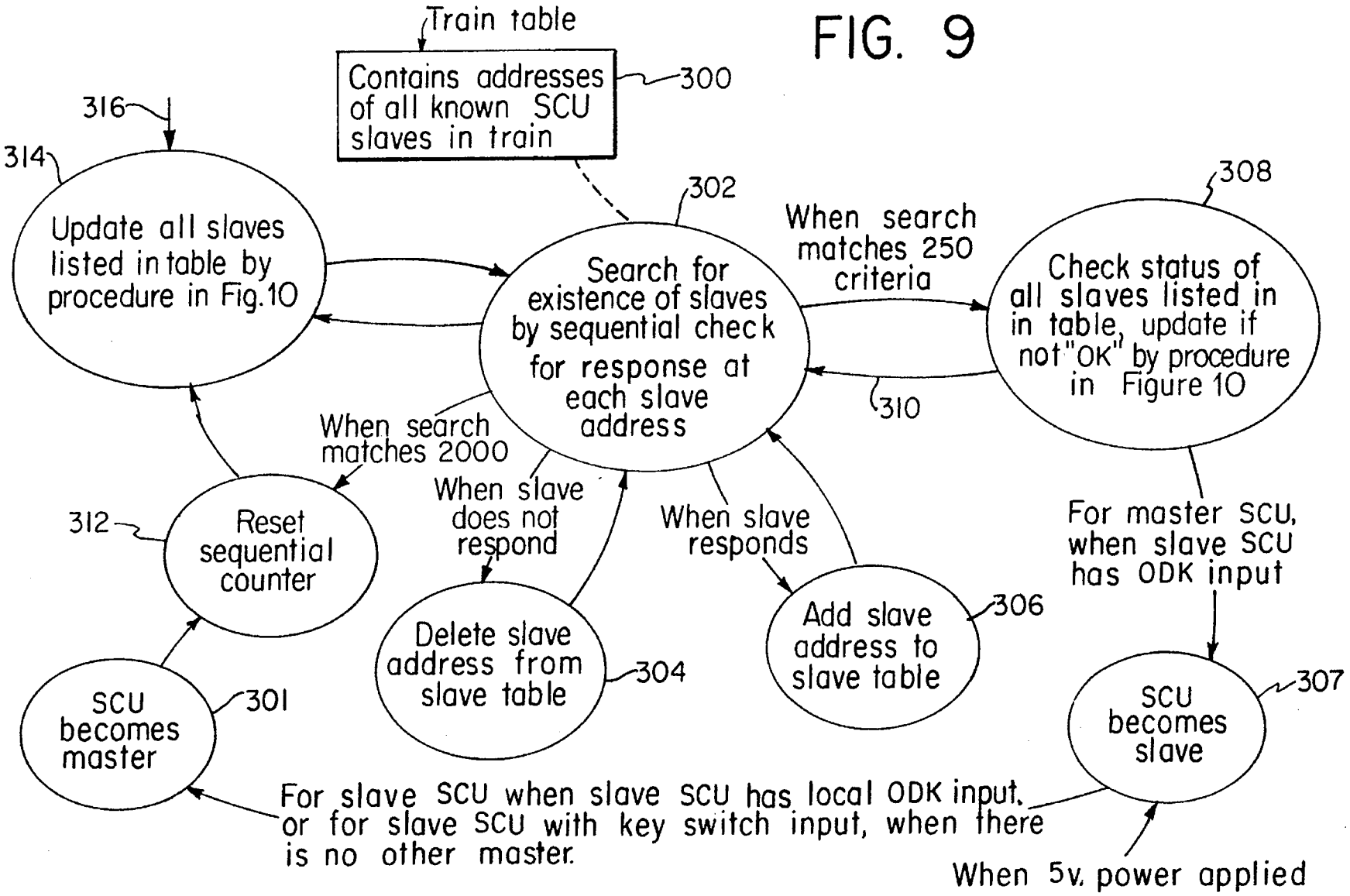
FIG. 9 is a function diagram showing the operation procedure for establishing which sign control units are active.

FIG. 9 is a function diagram illustrating a preferred way in which the master microprocessor 54 establishes which SCUs 16 (of the 2000 cars) form the particular train 10 so that it can then address them and communicate with them as necessary, and in addition sets the SCUs in proper condition. In order to save computing time and memory space, a slave table 300 is generated and provides a current list of address data designating those SCUs 16 that have been recognized as being connected to form the train 10. The train table 300 is kept in non-volatile memory and is continually updated in the search (i.e., polling) cycle indicated in FIG. 9. In the above example, the table should contain ten SCU addresses (nine slaves and one master).

First, by operation of its microprocessor 54, an SCU 16 becomes master upon actuation of the key-switch (indicated at circle 301). As indicated above, concurrently all other SCUs are conditioned to become slaves. The microprocessor then resets a sequential counter for the 2,000 addresses of the total number of SCUs (circle 312) and then updates all the slave units listed in table 300, by the procedure described below with respect to FIG. 10, to place them in the "OK" state (starting by an "Idle" signal as described below). In this update, each SCU listed in table 300 is interrogated; if there is no response (because the address is that of an SCU not in the train) that address is merely skipped.

The master microprocessor 54 then searches or polls through the entire list of possible SCU addresses (in this example, 2000), but not all at once. In order to provide prompt access to those SCUs which are in the train 10, only a predetermined portion of the total number, such as 250 addresses, is polled at a time. As indicated by circle 302, the microprocessor 54 will call each address of the first group and wait for a reply. If no reply is received from an SCU at that address in a pre-determined time, then it is assumed that no SCU exists in the train 10 with that address. If any of the SCU addresses that do not reply are already listed in the table 300, then these addresses will be removed from the table, as indicated by circle 304, after which the poll continues to the next address. If a reply is received by the microprocessor for a particular address, then that address is added to the train table 300, as indicated in FIG. 9 by circle 306, again resuming to the search (circle 302) when the addition is complete.

After a portion of the complete CPU list (e.g., after 250 addresses) is polled, the CPU 54 calls sequentially the SCUs 16 listed in the train table for a status check (indicated by circle 308). The status check procedure determines the status of the particular SCU, for example, is it in an "OK" state, an "Empty" state, a "Receive Configuration" state, etc., all described below. The SCU is then put into or kept in the "OK" state. Thus, each time the table is polled, all the SCU's listed in the table are placed in the "OK" state, ready for further commands. As indicated by arrow 310, after this checking the CPU 54 returns to the searching procedure (circle 302) and continues with the next group (e.g., 250 addresses), followed by again checking the status of those SCUs listed in the train table. This cycle (circle 308, arrow 310, circle 302) is repeated until the full set of SCUs (all 2000 in this case) has been polled, at which point the sequential address counter is reset to zero (circle 312) to prepare for the next full cycle.

By this cycle, the train table will list all SCUs in the train, and each SCU has been placed in "OK" status. If during this cycle, at circle 308, an ODK input is sensed at the master SCU addressed, the message data called for by that input is supplied to all SCUs in the manner described as to FIG. 10. This causes all the signs to display the data called for by the ODK input. The searching at 308 then continues.

If during the status check (circle 308) a slave SCU is addressed which has an input to its ODK, this is taken as an instruction to take over mastership. The previous master is made a slave, as at circle 307 (by switching off its voltage supply as described below) and the former slave SCU becomes the new master. As indicated by line 304, the new master enters the state shown in circle 301, and the process described above is repeated.

After resetting the address counter (circle 312), the new master CPU 54 then communicates with those SCUs whose addresses are listed in the table 300, which are thus the only SCU's of the possible 2000, for example, that are in the particular train arrangement. The SCU's listed in the train table are then updated (circle 314) with the current display sign information and/or checked to make sure that all signs of the train are displaying the proper message, with for example, appropriate configuration parameters, destination information, or the like to ensure that all display signs 18 of the train 10 display the correct message.

This polling of the full set of SCUs is done continuously, at a repetitive period of about 30 seconds. Thus regardless of whether any car is replaced, or if the train is reassembled with different cars, the train table is promptly made up and kept current. The train table is thus continuously updated to ensure that the master CPU 54 may correctly communicate with all the particular SCUs 16 present on the train 10. During each train polling cycle, (circle 302) the master CPU 54 will also check the status of the master ODK and of the slave units to determine whether any change is needed in the data determining the displays of the car signs of all cars. If the master ODK 20 has data, indicating a message change (as indicated by line 316), the new message will be transferred to all signs by a command to all the SCUs 16 of the train table, as described below.

Once the master CPU 54 has created an updated train table from available SCU 16 addresses, communication with all or any SCUs 16 in the train can be performed according to the procedures outlined in the chart shown in FIG. 10, while FIG. 10 is described in terms of control of peripherals (e.g., signs) from the SPB of an SCU (whether slave or master) it also illustrates the states of a slave SCU in response to various commands from the master SCU. Thus, the same diagram indicates the states of slave peripherals (e.g., signs) in response to commands from the SPB of each SCU 16 as well as the states of slave SCUs in response to commands from a master SCU.

Referring to FIG. 10, once the power of each car is turned on, after coupling the cars into a train to interconnect their trainlines 14, each peripheral of each slave SCU will be at an "Empty" condition, as indicated by condition circle 320 of FIG. 10. Depending on the type of sign used, the sign will either display nothing (a blank screen) or its last message prior to being turned off. With respect to each car of the train, the SPB of the SCU 16 will send a particular command such as a "Receive Configuration" command, indicated by the command arrow 322 to a display sign address stored in memory. The display sign 18 on that car at that address will assume a "Receive Configuration" condition (circle 324) which will be detected by the SPB portion of the car SCU as it polls its peripherals (i.e., signs 18 and the car's ODK 20) and which will indicate to the SCU 16 that the particular display sign is ready to receive general configuration data (such as length of the message, font type, etc.). The actual configuration data is then sent by the car SCU to the signs in turn, in a standard record format (e.g., 16 bytes per record) which includes a data terminator record, indicating the end of the particular data transmission. If any errors occur, as suggested by the circle 326 (labeled "Configuration Error"), as detected by a known check-sum method, the "Configuration Error" will be detected during polling by the SCU 16, and the configuration data will be re-sent, indicated by command arrow 328. If no errors occur and the peripheral display sign 18 successfully receives both the configuration data and the appropriate data terminator, the peripheral will enter into a "Need Data" state, indicated by circle 330, which, when read by the SPB of the SCU will indicate a request for legend data from memory.

The SPB of the SCU will then prepare to send the legend data to the sign by first sending a "Receive Data" command, command arrow 332 (meaning "are you ready to receive sign data?") to the particular peripheral display sign 18. The peripheral will place itself into a "Receive Data" condition (circle 334), which will indicate to the SPB (as detected during polling) that the peripheral is ready to receive data. Actual message data (representing the legend to be displayed by the signs 18) is then sent and again includes a data terminator record which is checked following the check sum procedure used before.

If there are "Data Errors", either as to the data or the terminator for data, as indicated by arrow 336, and the correct data transfer is incorrect or incomplete, the peripheral display sign 18 will enter a "Data Error" condition (circle 338). The "Data Error" condition will be received by the SCU 16, which will repeat the "Receive Data" command (command arrow 340, asking the peripheral "are you ready to try again?"). When no errors result and the entire legend data and data terminator record are received by the peripheral 18 (indicated by arrow 342) the peripheral enters into a "Wait Trigger" condition (circle 344), indicating to the SCU 16 that the peripheral 18 has received all the information sent and is ready (upon command from the SCU) to display the stored legend data.

At the appropriate time, the SPB of the SCU 16 sends a "Universal Trigger" command (command arrow 346) which will cause the peripheral 18 to display the message, placing the peripheral into an "OK" condition (circle 348). The "OK" condition is read by the SPB of the SCU 16, indicating that the display signs 18 are now displaying the desired message. The SCU 16 may change the message displayed by sending a new "Receive Data" command, to any particular peripheral 18 (command arrow 350), placing the status of the particular peripheral back to condition circle 340, and ready to receive new data.

If the message to be displayed is longer than the display sign 18 can accommodate (e.g., is a multi-line message), the sign will display a portion of the message in the "OK" condition (circle 348) which will indicate to the SCU to change the status of the peripheral to a "Need Partial Data" condition, needing another part of the message (circle 354). While in the "Need Partial Data" condition (circle 354), the display signs 18 will continue to display the previous message (partial data) until overridden by new data. The "Need Partial Data" condition 354 will be detected by the SCU, causing the SCU to send a new "Receive Data" command (command arrow 356), to the peripheral, placing the peripheral back to the "Receive Data" condition (circle 340). New data is sent, as before, during the "Receive Data" condition, again placing the peripheral into the "Wait Trigger" condition. The "Universal Trigger" command is sent after detection of the "Wait Trigger" condition signal, again placing the peripheral 18 into the "OK" condition so that the peripheral display sign 18 displays the message portion corresponding to the new data.

While the display signs 18 are operating, the SCU can initiate an "Idle" command, represented by command arrow 358, which changes the status of the peripherals from the "OK" condition 348 to an "Idle" condition (circle 360). This "Idle" command can be initiated during any condition except the empty condition (circle 320). The "Idle" condition functions as a pause control. The display sign 18 may continue to display the previous message, but all activity (data transfer) will cease, until a "Resume" command (arrow 362) is issued by the SCU 16. While in the "Idle" condition, a "Reset" command (arrow 364) can be sent to the peripherals 18 to reset their current condition back to "Empty" (circle 320).

As stated above, the operation of the SCU 16 of each car of the train 10 is controlled by the master SCU in one of the cars. The master SCU 16 communicates along the communication line 14 to the other SCUs 16 following the same process described and shown with respect to FIG. 10. In this instance, the master SCU functions in the same manner as the car SCU as described as to FIG. 10, and the car SCUs function in the same manner as the sign peripherals. In effect the master SCU of the train functions in the same way as the described operations of the controlling SPB of the slave SCU. For example, if the master SCU 16 has data to send to a particular slave SCU listed in the slave table 300, it will send a "Receive Configuration" command, as described above, to the particular slave SCU (then in the "Empty" state). The slave SCU will change its state to the "Receive Configuration" (circle 324 of FIG. 10). The new condition will be detected by a confirmation signal returned to the master SCU 16. As described above, configuration data will be sent to the slave SCU 16. The SCU 16 enters a "Need Data" condition, then a "Receive Data" condition after the master SCU sends a Receive Data command (arrow 332). Again legend data will be sent to the particular SCU 16 which will place it in the "Wait Trigger" condition with the legend stored. Once the SCU 16 with its stored legend message receives the "Universal Trigger" command, it will proceed to communicate with its own peripherals, the display signs 18, (as described above) following its own address order, as if it were the master SCU for its own car.

In any slave car, if an operator introduces data on the car's ODK 20, this is taken as a demand to take over mastership, and for the relays 42 of the requesting car and the previous master car to interchange states, so that the new master will provide the sole power for the trainline, as described above. The new master ODK 20 will enter a "Have Data" condition (circle 366) which will be detected by the car's SCU 16 during its polling procedure of its peripherals. Thus SCU 16 will request the new data by sending a "Send Data" command (arrow 368) placing the peripheral ODK 20 into a "Send Data" condition. Data will then be transmitted to the SPB of the SCU 16 in the form of data records (e.g. 16 bytes per record). After each record sent, the ODK 20 will enter a "Wait Acknowledge" condition (circle 374) to wait for the SPB to continue the transmission by sending a "Continue Send Data" command (arrow 376). If there are errors during transmission, the SCU will automatically send another "Send Data" command (arrow 377) to restart the transmission. Once the SPB of the SCU receives all the new data from the ODK 20, it will enter a "Have Data" condition with respect to the entire trainline which will be detected by the master SCU of the trainline during its polling of all the SCUs 16. This will cause the slave SCUs (whose ODK has data) to request mastership from the previous master SCU, and transfer mastership to the SCU whose ODK has the new data. The SCU 16 with the new data, now the new master SCU of the trainline, will then send the new data to all the other SCUs 16 of the train 10 in the order that they appear in the slave table 300 and simultaneously proceed to pass the new data to its own peripherals within its car. After each slave SCU 16 receives the new data from the new master SCU 16, it will in turn proceed in a similar manner to pass on the new data to its local peripherals, such as the car's display signs 18 and ODK 20.

In order for the master SCU 16 to display the new data received from it's ODK 20, it must send an "Idle" command to the display portion of the ODK 20, (arrow 378), thereby placing the ODK's display into the "Idle" state (circle 360). A "Reset" command from the SCU 16 will then put the ODK's display in the "Empty" state from which it can proceed to reload the new data into the ODK's display, so that the operator can view the decoded equivalent of what he has inputted. After the ODK's display is in the "OK" state, the local SCU (which is now the master SCU) will continue to distribute message data to its other peripheral addresses, as they appear in the SCU's memory.

SUMMARY OF OPERATION

In operation of the entire trainline system, upon initialization of the master SCU 16 by actuation of the first key-switch car of the train 10, the relay 42 of the master SCU 16 is activated and held closed so that power from the output of voltage regulator and current controller 40 is sent along the communication line 14 to all the other SCUs 16 (slaves). The equivalent master/slave connect relay 42 in the slave SCUs will be kept de-activated and therefore the regulator 40 of each slave SCU 16 will remain isolated from the communication line 14. When the master CPU 54 desires to send commands or message data to any or all the slave SCUs 16, it sends corresponding coded binary pulses representing the command or message data to its transmitter circuit 44, which shunts the voltage across the communication line 14 by a low resistance in correspondence with the binary data, and thus transposes the same binary data signals from the CPU 54 to the communication line 14 in the form of a pulse-modulated voltage signal. The modulated signal is sent to all the SCUs 16 of the train 10 and read by the receiver portion of each slave SCU 16. If the address information of the received signal includes the address of a particular slave SCU 16, then the data will be accepted and processed by the CPU 54 that SCU 16. Other SCUs 16 will ignore that signal. The addressed SCU 16 will follow the commands of the data in accordance with the procedure described above and will communicate with and control the display signs 18 and ODK 20 of its car, as necessary, until the commands are complete. During the communication procedure, acknowledgement or confirmation responses from the polled slave SCU 16 are provided by causing its mosfet 168 (FIG. 7) to short the communication line 14 in an appropriate binary coded manner. The voltage change thus produced is read by the master circuit's receiver (FIG. 8), as described. Any car may become the master unit by actuation of its ODK.

If an operator, located in a non-master (slave) car of the train 10, desires to change the message to be displayed by the signs located in the cars of the train, he may do so through that car's ODK 20. The new message will be detected by the slave CPU 54 during its continuing polling procedure and will send a "request to become master" to the pre-existing master CPU 54. The existing master CPU 54 will exchange mastership by deactivating its master/slave connect relay 42, and immediately causing the requesting slave CPU 54 to activate its own master/slave connect relay 42 and become the master SCU 16 of the entire train 10. The inputted message from the actuated ODK 20 is then displayed by the display signs 18 of all cars, as described above.

One advantage of the present system is that the data signal is not degraded by the numbers of slaves in the system (up to the designed maximum). This is because the voltage regulator 40 has a relatively low output impedance and is in the constant voltage state when all receivers are high (quiescent or mark state). This is in contrast to conventional train systems which utilize a much higher impedance voltage source, whose voltage drops by an appreciable amount as the load of each receiving load is added to the system in increasing the number of slave units accommodated.

Moreover, a quick transition is provided from a low voltage (space) state to a high voltage (mark) state. This is created by having the regulator in a constant current state during the spaces. Upon change to the mark state, this causes charging of the line capacitor linearly (rather than exponentially as is conventional for high impedance sources), resulting in faster transition, permitting higher baud rates. This also permits handling higher resistance in the trainline wires or their couplings between cars, and hence, more slave units.

The quick transition from high to low states uses a power mosfet as the shunting device. Such a mosfet is fast in transition from no conduction to full conduction, and can quickly shunt a large amount of current with a high current rating. It also has low gate current requirements, suitable for drive from a voltage source powering the trainline.

Another feature is the use for the trainline of an unterminated non-closed wire pair, aiding in the capability of having the master anywhere along the trainline.

While the above system has been described primarily with respect to providing controllable message displays or destination signs for subway or train cars, it will be understood that the invention is applicable to other systems having control of multiple message displays or other devices. For example, in a highway traffic control system or an airport message display system, message display signs may be located at various points along the system, which may be controlled from any sign location by use of the present invention, with the various locations being interconnected solely by a single wire pair. Other devices, such as car safety devices or controls may also be made controllable from any selected car.

It will be understood that the foregoing description is to be deemed merely illustrative of the present inventions, which may readily be varied or modified by those ordinarily skilled in the art. The inventions shall be deemed defined solely by the appended claims.

We claim:

1. A communication system comprising a plurality of spatially separated units, each unit comprising (a) a communication line section consisting of two continuous galvanically conductive wires, the line section of each unit being galvanically serially connected to the line sections of all other units to form a single two-wire line for all units, (b) a transmitting circuit, and (c) a receiving circuit, each of said transmitting circuits and receiving circuits being connected in parallel across said line at its respective location whereby all said circuits are connected directly to said two wires, a single direct voltage source connected across said line at only one point thereof at any one time and providing the only source of voltage on said line, each transmitting circuit comprising means for causing the voltage on said line produced by said voltage source to vary at all points along said line between a high level and a low level in correspondence with a binary signal to be transmitted, all said receiving circuits being adapted to respond to variation of voltage on said line caused by a transmitting circuit of any one unit, to reproduce said signal.

2. A system as in claim 1 in which said means for varying voltage at each transmitting circuit comprises a shunting circuit for placing a low impedance shunt across said line in correspondence with said signal.

3. A system as in claim 1, said source including a regulator providing a regulated voltage output for currents up to the aggregate standby current drain from all said transmitting and receiving circuits, and providing a regulated current output for current drain substantially greater than said standby drain, said shunt-applying means being operative to provide a current draw from said regulator to cause said regulator to operate in a regulated-current mode.

4. A system as in claim 1 wherein said voltage source has the characteristic of maintaining substantially uniform voltage output for loads across said line having resistance above a predetermined value.

5. A system as in claim 1 wherein said voltage source has the characteristic of maintaining substantially uniform current for loads across said line having resistance below a predetermined value.

6. A system as in claim 1 wherein said voltage source has the characteristic of maintaining substantially uniform voltage output for loads across said line having resistance above a predetermined value, and also of maintaining substantially uniform current for loads across said line having a resistance below a predetermined value.

7. A message display system comprising a plurality of units as in claim 1, a plurality of message display devices, each of said units being a sign control unit associated with one or more of said display devices at a respective unit location, said sign control units being connected to one another solely by said two-wire line, each sign control unit also comprising a said voltage source whose output is coupled across said line, an operator's control, a said transmitting circuit coupled across said line, a said receiving circuit coupled across said line, and a microprocessor, means responsive to actuation of said operator's control of a sign control unit at one location for activating the voltage source at that location to cause the sign control unit at that location to become a master unit and to deactivate the voltage sources at all other locations to cause the sign control units at said other locations to become slave units, said activated voltage source being connected to said line as the sole source of excitation for said line, each transmitting circuit being adapted to place a low impedance load across said line in correspondence with a binary data signal input to said transmitting circuit, to modulate the voltage across said line between a high voltage level and a low voltage level, said levels representing and corresponding to binary data bits of said input signal, and each said receiving circuit including means for receiving said modulated voltage from said line and deriving therefrom a binary data signal, whereby said master unit may communicate with each of said slave units by modulating the voltage on said line by the master transmitting circuit, and each slave unit may communicate with said receiver circuits by modulating the voltage on said line by its respective transmitting circuit.

8. A system as in claim 2 wherein each said receiving circuit comprises a zener diode having a regulating voltage and connected between the wires of said line, the regulating voltage of said zener diode being greater than the voltage at any receiving circuit caused by the maximum resistive volt-drop in said line between said voltage source and receiving circuit when said shunt is across said line and less than the voltage at any receiving circuit in the absence of placing said low impedance shunt across said line.

9. A communication system comprising a transmitting circuit, a receiving circuit, a two-wire line connecting said circuits, a single voltage source connected across said line for supplying voltage to said line, means for transmitting from said transmitting circuit to said receiving circuit binary information in the form of a sequence of binary bits of two types representing marks and spaces of a binary signal, comprising means at said transmitting circuit for applying a low impedance shunt across said line to reduce the voltage at said receiving circuit in correspondence with each occurrence of a bit of said binary information of one type, said voltage source having means maintaining both a substantially uniform voltage for loads across said line having a range of impedances greater than said low impedance and a substantially constant current for loads across said line having a range of impedances substantially equal to or less than said low impedance.

10. A system as in claim 9 wherein said receiving circuit includes an input having a zener diode connected across said line, said diode having a regulating voltage at least as large as the voltage at said receiving circuit caused by the resistive volt-drop in said line between said transmitting and receiving circuits during application of said shunt, said regulating voltage also being less than that of said voltage source, whereby said diode will conduct only in the absence of application of said low impedance shunt.

11. A method of communicating among units spaced along a continuous two-wire conductive line, where each unit has a transmitter and a receiver connected to said line, comprising the steps of applying to said line a voltage source having a substantially constant-voltage variable-current mode for currents up to a predetermined current limit and a substantially constant-current mode for a current in excess of said limit, and transferring between said constant-voltage mode and said constant-current mode in correspondence with a binary signal.

12. A method as in claim 11 further including applying said voltage source at a single point along said line, said source being the only power source on said line, and causing said transferring by action of any of said transmitters.

13. In a control system for trains having a plurality of cars, each having a continuous conductive trainline extending from one end of the car to the other end of the car, a power supply circuit for supplying power to said train line, a car ground, a transmitting circuit, and a receiving circuit, with each of said transmitting and receiving circuits connected to said trainline to receive power from the trainline, the combination comprising, a first means for activating a car to become a master car, means operative upon activation of a master car for connecting the car ground of said master car to said trainline and disconnecting all other car grounds from said trainline, and means isolating the non-master receiving and transmitting circuits from the grounds of their respective cars.

14. A system as in claim 13 including one or more controllable display devices at each car, means causing the master transmitting circuit to shunt a low impedance load across said line in correspondence with a control signal for controlling said devices, and means at each receiving circuit for responding to such shunting for controlling the display devices at the respective car.

15. A system as in claim 13, including means at each car to cause it to become the master car in substitution for a previous master car regardless of its position in the train.

16. A method of communicating in trains having a plurality of cars and a two-wire trainline extending continuously from car to car, each car having a unidirectional power supply circuit adapted to be connected to said line to supply power thereto, a transmitting circuit, a receiving circuit, and a car ground, with each of said transmitting and receiving circuits being connected to the train line in its respective car to derive power therefrom, the steps of:

connecting the power supply circuit of one car to said train line, and concurrently disconnecting the power supply circuits of all other cars from the train line.

17. The method as in claim 16, wherein each car also has a display device, and including the steps of causing the transmitting circuit of one car to shunt a low resistive impedance across said train line in correspondence with a signal, causing at least one receiving circuit to respond to such shunting, and controlling by said one receiving circuit the display device at such receiving circuit.

18. A method as in claim 16, including the steps of causing a different car from said one car to have its power supply circuit connected to said train line, and concurrently disconnecting the power supply circuit and ground of said one car from said train line.

19. A method as in claim 18 further including the steps of causing one transmitting circuit to apply to the train line a first voltage representing a first type binary bit of a coded binary a digital signal to be transmitted, causing said transmitting circuit to apply a low impedance across the train line to change the voltage on the train line from said first voltage to a lower voltage representing a second type of binary bit of said signal, and causing the receiving circuit in each car to respond to said first and lower voltages to receive said signal.

20. A method as in claim 19 further including the step of causing a different car from said one car to have its supply circuit and ground connected to said train line, and concurrently disconnecting the supply circuit and ground of said one car from said train line.

21. A communication system for a multi-car train comprising a plurality of spatially separated units, each unit comprising (a) a communication line section consisting of two continuous galvanically conductive wires, the line section of each unit being galvanically connected serially to the line sections of all other units to form a single two-wire line for all units, (b) a transmitting circuit, and (c) a receiving circuit, each of said transmitting circuits and receiving circuits being connected in parallel across said line at its respective location whereby all said circuits are connected directly to said two wires, a single direct voltage source connected across said line at one point thereof and providing the only source of voltage on said line, each transmitting circuit comprising means for causing the voltage on said line produced by said voltage source to vary at all points along said line between a high level and a low level in correspondence with a binary signal to be transmitted, each of said units being in a separate train car, and said two-wire line extending serially from car to car along said train from one end of the train to the other, each car of the train having a said transmitter and a said receiver, said voltage source being coupled across said line at a selected (master) car, said line having no other voltage or power sources connected to said line, said voltage-varying means comprising means at each transmitter to apply a shunt to said line in accordance with one bit of a binary signal to increase the current in said line from said voltage source and to reduce the voltage across said line at the receivers of all cars during such shunting, and each receiver having means to respond to said voltage reduction to detect said signal.

22. A communication system comprising a plurality of spatially separated units, each unit comprising (a) a communication line section consisting of two continuous galvanically conductive wires, the line section of each unit being galvanically connected serially to the line sections of all other units to form a single two-wire line for all units, (b) a transmitting circuit, and (c) a receiving circuit, and (d) a direct voltage source, each of said transmitting circuits and receiving circuits being connected in parallel across said line at its respective location whereby all said circuits are connected directly to said two wires, a single one of said voltage sources being connected across said line at one point thereof and providing the only source of voltage on said line, each transmitting circuit comprising means for causing the voltage on said line produced by said voltage source to vary at all points along said line between a high level and a low level in correspondence with a binary signal to be transmitted, all said receiving circuits being adapted to respond to variation of voltage on said line caused by a transmitting circuit of one unit, to reproduce said signal, and means assuring that at any time only a selectable one of said voltage sources is connected to said line and that all other voltage sources are concurrently disconnected from said line.

23. A communication system comprising a plurality of spatially separated units, each unit comprising (a) a communication line section consisting of two continuous galvanically conductive wires, the line section of each unit being galvanically connected serially to the line sections of all other units to form a single two-wire line for all units, (b) a transmitting circuit, (c) a receiving circuit, and (d) a ground each of said transmitting circuits and receiving circuits being connected in parallel across said line at its respective location whereby all said circuits are connected directly to said two wires, a single direct voltage source connected across said line at one point thereof and providing the only source of voltage on said line, each transmitting circuit comprising means for causing the voltage on said line produced by said voltage source to vary at all points along said line between a high level and a low level in correspondence with a binary signal to be transmitted, all said receiving circuits being adapted to respond to variation of voltage on said line caused by a transmitting circuit of one unit, to reproduce said signal, and means assuring that at any time only a selectable one of said grounds is connected to one wire of said line and that all other grounds are disconnected from said line.

24. A communicating system for a plurality of spatially separated units, said units being interconnected only by a single line formed of two continuously conductive wires, each unit comprising (a) a voltage supply circuit adapted to supply voltage to said line, (b) a transmitting circuit, and (c) a receiving circuit, the transmitting circuit and receiving circuit of each unit being continuously connected across said two-wire line, means at each unit for causing its voltage supply circuit to be connected across said line, and means operative upon connection of one voltage supply circuit to said line for causing the voltage supply circuit of all other units to be disconnected from said line, whereby said entire line is supplied from only one voltage supply circuit at any time.

25. A system as in claim 24 wherein each said voltage supply circuit includes a ground adapted to be connected to one of said line wires, whereby said line is provided with a ground from only one voltage supply circuit, each of said transmitting and receiving circuits being provided with a ground only by said line.

26. A system as in claim 25 including isolating means for isolating each transmitting circuit output and receiving circuit input connected to said line from other circuits in their respective units.

27. A train communication system having cars of the train connected directly by a two-wire train line running continuously and conductively from car to car, each car having a power source, a receiver and a transmitter comprising:

means for causing any car to be a master unit and for concurrently disconnecting the power sources of all of the other cars from said train line, leaving the master unit power source as the sole power source for the line, means for causing the master unit to apply to said line a high voltage representing a binary bit of a first type of a binary digital signal to be transmitted, the transmitter in each car being coupled to said train line and being adapted to apply a low impedance across the train line to change the voltage on the train line from a value representing said first type bit to a lower value representing a second type binary bit, in correspondence with said binary digital signal, the receiver in each car being coupled to said train line and being adapted to receive said signal.

28. A message display system comprising:

a plurality of message display devices, a two-wire communication line, a plurality of sign control units, each at a different location, and each associated with one or more of said display devices at a respective location, said sign control units being connected to one another solely by said two-wire communication line, each sign control unit comprising a voltage supply whose output is coupled across said line, an operator's control, a transmitting circuit whose output is coupled across said line, a receiving circuit whose input is coupled across said line, and a microprocessor, means responsive to actuation of said operator's control at one location for causing the microprocessor at said location to activate the voltage supply at that location to cause the sign control unit at that location to become a master unit and to disconnect the voltage supplies at all other locations from said line to cause the sign control units at said other locations to become slave units, said activated voltage supply being connected to said communication line as the sole source of power for said line.

29. A system as in claim 28, each transmitting circuit being adapted to place a low impedance load across said communication line in correspondence with a binary data signal input to said transmitting circuit, to modulate the voltage across said communication line between a high voltage level and a low voltage level, said levels representing and corresponding to respective binary mark and space bits of said input signal, each said receiving circuit including means for receiving said high and low voltage levels from said communication line and deriving therefrom said binary data signal, whereby said master unit may communicate with each of said slave units by modulating the voltage on said communication line by the master transmitting circuit, and each slave unit may communicate with said receiving circuits by modulating the voltage on said line by the slave transmitting circuit.

30. A communication system comprising plurality of spatially separated units, each unit comprising (a) a communication line section consisting of two continuous galvanically conductive wires, the line section of each unit being galvanically connected to the line sections of all other units to form a single two-wire line for all units, (b) a transmitting circuit, and (c) a receiving circuit, each of said transmitting circuits and receiving circuits being connected in parallel across said line at its respective location whereby all said circuits are connected directly to said two wires, a single direct voltage source connected across said line at one point thereof and providing the only source of voltage on said line, each transmitting circuit comprising means for causing the voltage on said line produced by said voltage source to vary at all points along said line between a high level and a low level in correspondence with a binary signal to be transmitted, all said receiving circuits being adapted to respond to variation of voltage on said line caused by a transmitting circuit of one unit, to reproduce said signal.

* * * * *